US006143700A

United States Patent [19]

Kato

[11] Patent Number: 6,143,700

[45] Date of Patent: Nov. 7, 2000

[54] TREATING AGENT FOR ELECTRICAL CONTACTS

[75] Inventor: Masaru Kato, Saitama-ken, Japan

[73] Assignee: Kanto Kaguka Kabushiki Kaisha, Tokyo, Japan

[21] Appl. No.: 09/243,336

[22] Filed: Feb. 1, 1999

[30] Foreign Application Priority Data

Feb. 4, 1998 [JP] Japan ..... 10-036571

[51] Int. Cl.[7] ..... C10M 129/16; C10M 173/02; C10M 133/38

[52] U.S. Cl. ..... 508/268; 508/269; 508/305; 508/581

[58] Field of Search ..... 508/581, 305, 508/268, 269

[56] References Cited

U.S. PATENT DOCUMENTS

| | | | |
|---|---|---|---|
| 3,860,661 | 1/1975 | Hammann et al. | 508/581 |
| 4,897,211 | 1/1990 | Dekura | 508/581 |
| 5,221,709 | 6/1993 | Irvine et al. | 524/452 |

FOREIGN PATENT DOCUMENTS

| | | |
|---|---|---|
| 60-115696 | 6/1985 | Japan . |
| 60-115696A | 6/1985 | Japan . |
| 60-116795 | 6/1985 | Japan . |
| 60-116795A | 6/1985 | Japan . |
| 4-193982 | 7/1992 | Japan . |
| 4-193992 | 7/1992 | Japan . |
| 7-258889 | 10/1995 | Japan . |
| 7-258891 | 10/1995 | Japan . |
| 7-258894 | 10/1995 | Japan . |
| 1065831 | 4/1967 | United Kingdom . |

OTHER PUBLICATIONS

M. Antler, et al., Wear, 6, pp. 44–65.

A612B Annu Connector Interconnections Symp. Prc. (USA) 19th 1–13 (1986).

*Primary Examiner*—Jacqueline V. Howard
*Attorney, Agent, or Firm*—Darby & Darby

[57] ABSTRACT

A treating agent for electrical contacts which is nonflammable and free from environmental pollution and imparts lubricity and corrosion resistance as good as or better than any known treating agent. This treating agent is a solution of polyphenyl ether in an organic solvent derived from lactone, lactam, or cyclic imide, said organic solvent containing or not containing a certain amount of water.

13 Claims, 4 Drawing Sheets

TREATING AGENT FOR ELECTRICAL CONTACTS

BACKGROUND OF THE INVENTION

1. Field of the Invention

The present invention relates to a treating agent to impart lubricity and corrosion resistance to the surface of electrical contacts coated with noble metal.

2. Description of the Related Art

Electrical contacts are coated commonly with noble metal (such as gold, palladium, and silver) or alloy thereof. Nowadays, their coating film getting very thin for cost reduction or owing to technical advancement. Especially, gold coating is being replaced by palladium (or palladium alloy) coating with flash gold plating. Reduction in coating thickness poses a problem with corrosion due to pinholes. In addition, electrical contacts with thin gold plating alone needs great force to be pushed in and pulled out, with the possibility of it wearing off. A common way to improve corrosion resistance, lubricity, and wear resistance is by post-treatment for the surface of electrical contacts.

The post-treatment is accomplished by dipping electrical contacts in a solution of a lubricant and corrosion inhibitor in a halogenated organic solvent. The lubricant includes liquid paraffin and wax which remain on the surface of electrical contacts, and the corrosion inhibitor clogs pinholes, thereby contributing to corrosion resistance. Much has been studied about solid and semi-solid lubricants. Antler (Bell Laboratory) cited in his work [Wear, 6, pp. 44–66 (1963) and Connectors Interconnections Symp. Proc. 19th, pp. 1–13 (1986)] typical reports such as Stanford Res. Inst., Rept. No. 12 for Project No. PU-31521, Jul. 1, 1961 (on wax), Proc. Inst. Elec. Engrs. (London) 100 174 (1953) (on Teflon resin), and Pa. State Univ., Jun. 8–12, 1959 (on petroleum jelly). Other common lubricants are liquid paraffin and squalane.

After that, a new high-performance lubricant was developed for spacecraft equipment and nuclear power equipment. It is polyphenyl ether (such as bis(phenoxyphenoxy) benzene and bis-(m-(m-phenoxyphenoxy)phenyl)ether). It was shown by the above-mentioned Antler's work to exhibit good lubricating characteristics when applied to electrical contacts. Since then it has come into general use.

Some sealing lubricants have been proposed as follows:

[1] A solution in trichloroethane of 0.1–3 wt % petrolactam (ointment-like petroleum wax) and 0.05–3 wt % chelate-forming cyclic nitrogen compound(s). JP, A, 4-193982.

[2] A solution in trichloroethane of 0.1–3 wt % paraffin wax and 0.05–3 wt % alkyl-substituted naphthalenesulfonate(s). JP, A 4-193992.

[3] A solution of 0.1–5 wt % paraffin wax and petrolactam (s) in petroleum solvent (such as toluene and xlene), alcoholic solvent (such as isopropyl alcohol), or paraffinic solvent (such as n-decane). JP, A 7-258889.

Commercial sealing lubricants for plated contacts are classified according to metals (such as gold, silver, and tin) to which they are applied. All of them are solutions in 1,1,1-trichloroethane or fluorocarbon solvent. Such solvent solutions, however, are being replaced by aqueous solutions in consideration of their effect on environment. For example, JP, A, 7-258891 discloses treatment with an organic solvent solution of 0.1–5 wt % paraffin wax and petrolactam(s) floating in layer (1–10 mm thick) on an aqueous solution. JP, A, 7-258894 also discloses an aqueous solution of fatty acid soap and aminocarboxylic acid for use as a sealing lubricant.

There are some disclosures concerning polyphenyl ether used for lubrication of tin-plated contacts. For example, JP, B2, 3-80198 discloses a polyphenyl ether-based lubricant containing a copolymer of perfluoroalkylene and acrylate ester or a phosphate ester having benzene rings as lipophilic groups in an amount more than 0.5%. JP, B2, 5-22322 also discloses a tin-plated connector contact treated with a polyphenyl ether-based lubricant containing a phosphate ester surfactant having benzene rings as lipophilic groups in an amount more than 0.5%. The first disclosure is concerned with a method of applying polyphenyl ether directly to the tin plating film or tin-lead alloy plating film on contacts which is poor in wettability. The second disclosure is concerned with a contact treated with polyphenyl ether.

SUMMARY OF THE INVENTION

Polyphenyl ether exhibits good lubricity but suffers the disadvantage of being extremely high in viscosity and absolutely insoluble in water (although soluble in organic solvents such as alcohols, esters, and chlorinated hydrocarbons). So far, polyphenyl ether have been used in the form of solution in halogenated hydrocarbon solvents (such as 1,1,1-trichloroethane and methylene chloride) as in the case of known sealing lubricants, because of their high dissolving power, ability for uniform dispersion, easy drying and removal after treatment, and nonflammability (exempt from Japanese Fire Protection Law). However, these solvents are going to be totally banned in near future from the standpoint of global environmental protection (they are suspected to destroy the ozonosphere). For this reason, there has arisen a need for switching them to safer ones.

Under these circumstance, there is a move to switch the solvent for polyphenyl ether to isopropyl alcohol. Although alcoholic solvents are comparable to halogenated hydrocarbon solvents in dissolving power and removability after treatment, they (including isopropyl alcohol) are flammable and need careful handling. This implies that every equipment in the plating plant has to be replaced by explosion-proof one with considerable expenses. The same is true for all organic solvents designated as hazardous material by fire protection law.

Moreover, solvents for lubricants should be able to dissolve polyphenyl ether, and after treatment they should leave polyphenyl ether uniformly and volatilize completely without adversely affecting electric properties. This requirement has stimulated the development of a post-treating agent. Thus, the object of the present invention is to find a safe treating agent for contacts which does not employ any flammable solvent (such as hydrocarbon and alcohol) to dissolve polyphenyl ether but imparts good lubricity and wear resistance to the surface of contacts like the conventional treating agent based on halogenated hydrocarbon solvents.

In order to achieve the above-mentioned object, the present inventors carried out a series of researches, paying their attention to a solvent derived from lactone, lactam, or cyclic imide, which is less flammable (due to high flash point), capable of dissolving various oils, and miscible with water. As the result, they successfully developed a treating agent for electrical contacts which dissolves polyphenyl ether completely, spreads uniformly over the surface of contacts, and presents no danger of ignition.

The first aspect of the invention resides in a treating agent for electrical contacts comprising polyphenyl ether in one or more organic solvents selected from lactones, lactams, or cyclic imides.

The second aspect of the invention resides in said treating agent for electrical contacts further comprising water.

DESCRIPTION OF THE PREFERRED EMBODIMENTS

According to the present invention, the treating agent contains polyphenyl ether as a component to impart lubricity. Polyphenyl ether includes, for example, bis (phenoxyphenoxy)benzene and bis(m-(m-phenoxyphenoxy) phenyl)ether, which are commercially available under the trade name of OS-124 and OS-138, respectively, from Monsanto Inc. It should be used in an amount of 0.5–10 wt %, preferably 1–3 wt %, of the total amount. The ratio of water should usually be 20–30 wt %, although 10 wt % is enough to eliminate flammability.

The treating agent of the present invention may be incorporated with an optional metal inhibitor which is a nitrogen- or sulfur-containing organic compound such as N,N'-benzotriazole, octadecanethiol, and 2-mercaptobenzothiazole. The invention will be described in more detail with reference to the following examples.

EXAMPLES 1 TO 7 AND COMPARATIVE EXAMPLES 1 TO 3

Figure 1:
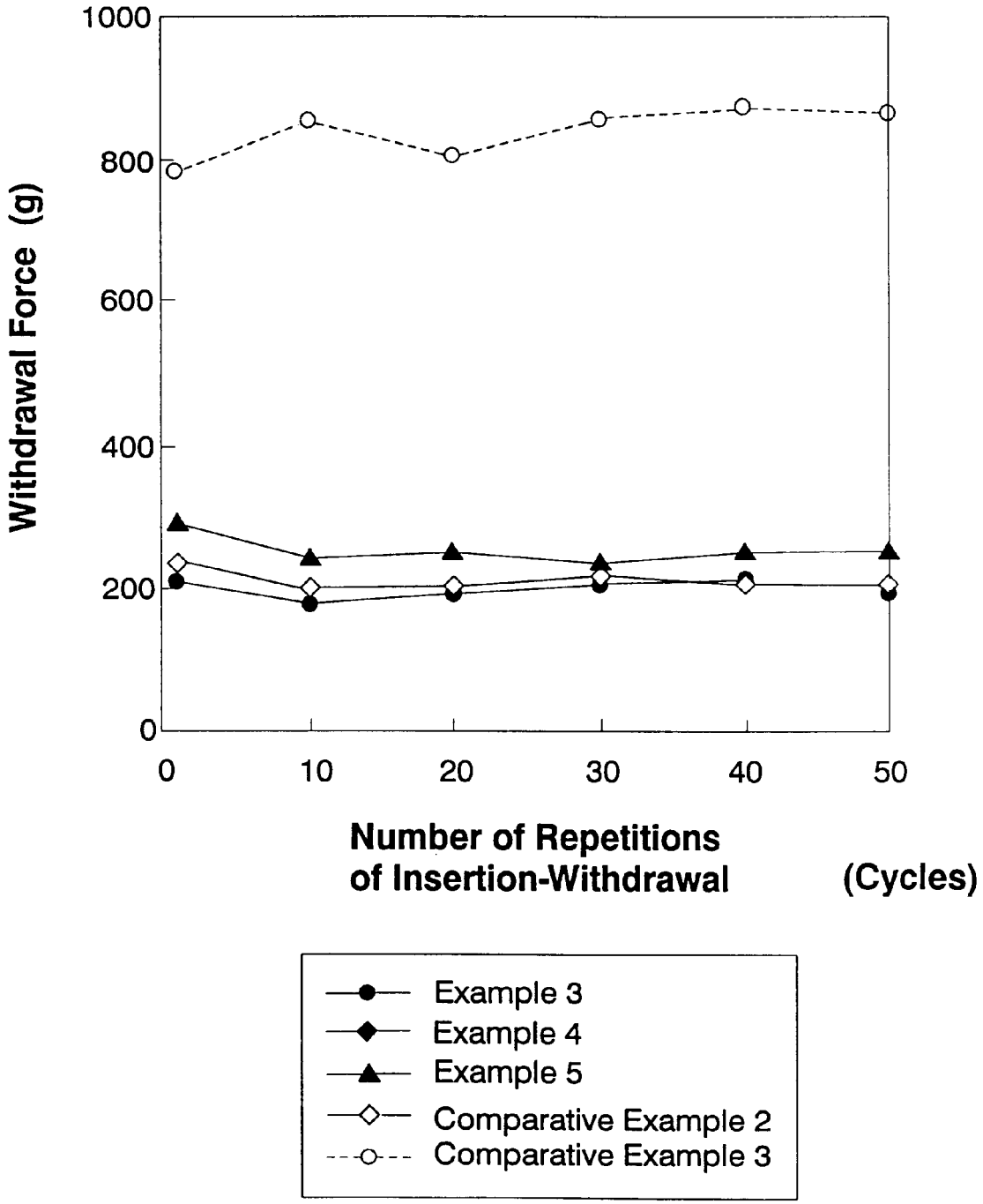
FIG. 1 is a graph showing the relation between the number of repetitions of insertion-withdrawal test and the withdrawal force in the case of contacts treated with the samples in Examples 3 to 5.
Figure 2:
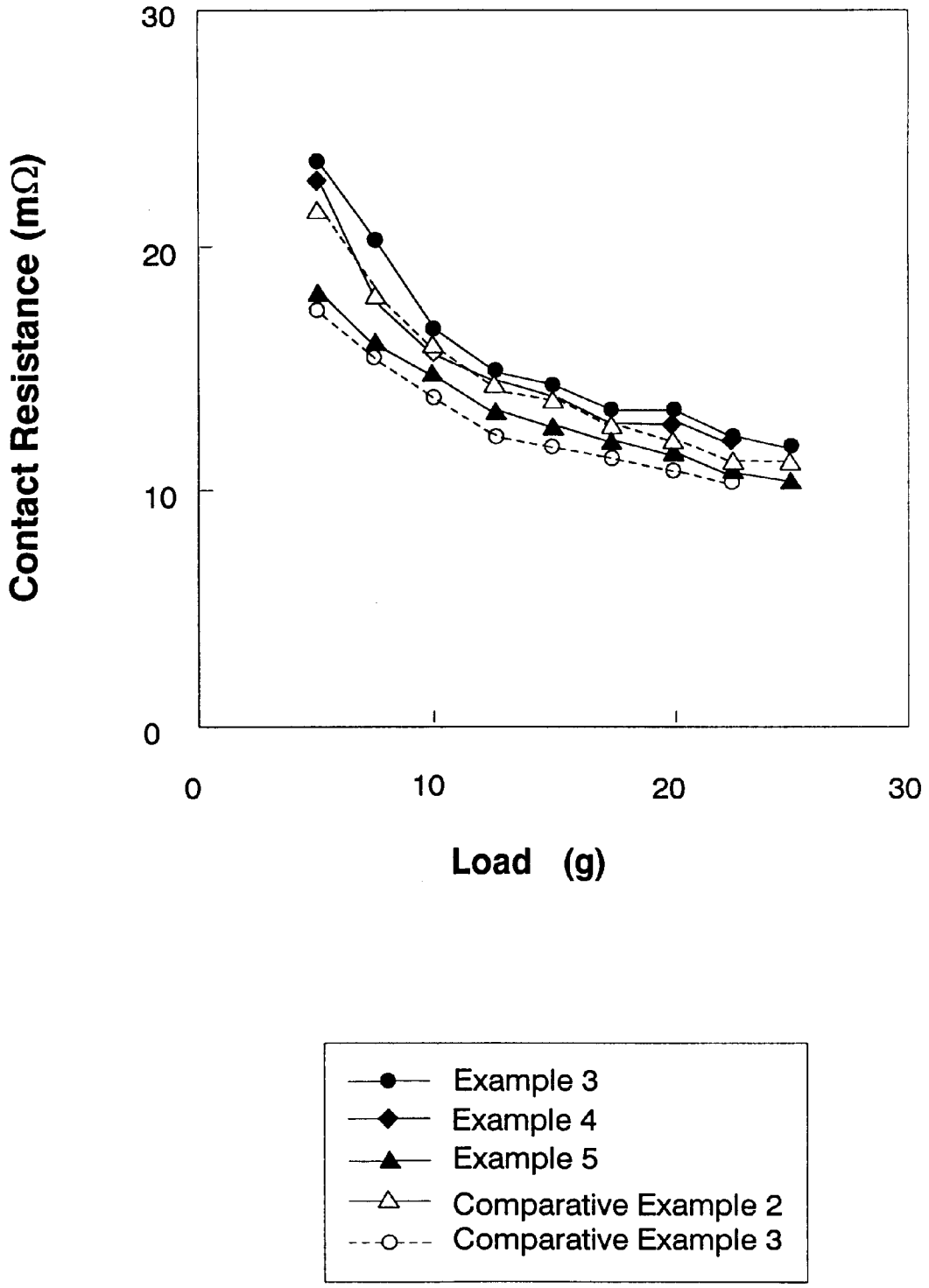
FIG. 2 is a graph showing the relation between the contact resistance and the load immediately after treatment with the samples in Examples 3 to 5.
Figure 3:
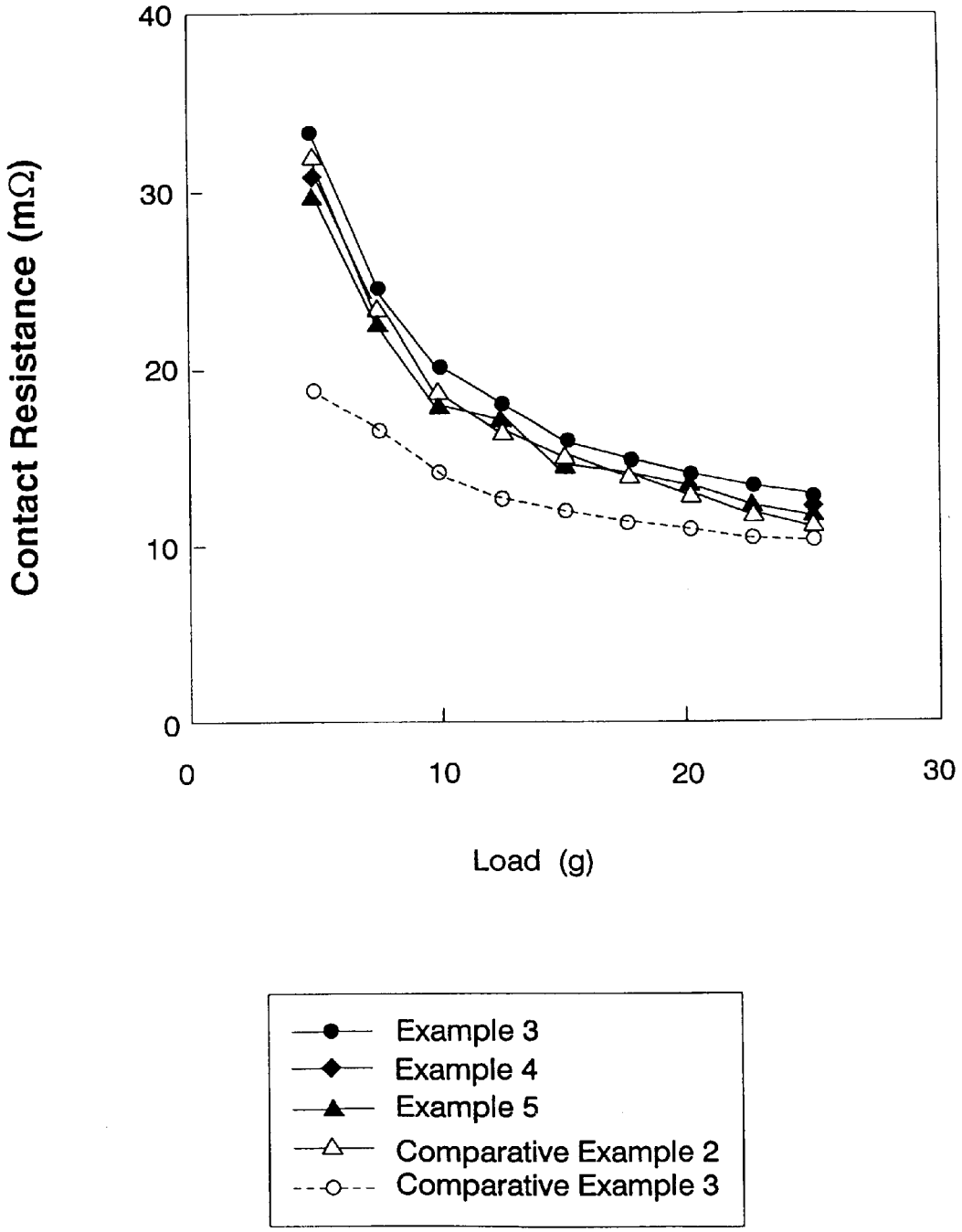
FIG. 3 is a graph showing the relation between the contact resistance and the load after treatment with the samples in Examples 3 to 5, followed by heat treatment at 125° C. for 96 hours.

Samples of treating agents for electrical contacts were prepared according to the formulations shown in Table 1. They were tested for characteristic properties, and the results are shown in Table 1. Samples in Examples 3 to 5 were tested for ease with which they are pushed in and pulled out and also for contact resistance, and the results are shown in FIGS. 1 to 3.

TABLE 1

| | Example | | | | | | | Comparative Example | | |
|---|---|---|---|---|---|---|---|---|---|---|
| Item | 1 | 2 | 3 | 4 | 5 | 6 | 7 | 1 | 2 | 3 |
| OS-124 | 2 | 2 | 5 | 2 | 1 | 1 | 2 | 1 | 2 | Not |
| N-methyl-2-pyrrolidone | 98 | 80 | 75 | 75 | 76 | 71 | 70 | 64 | 0 | |
| Methylene chloride | — | — | — | — | — | — | — | — | 98 | |
| Water | 0 | 18 | 20 | 23 | 24 | 29 | 28 | 35 | 0 | |
| State of solution | ○ | ○ | ○ | ○ | ○ | ○ | Δ | X | ○ | — |
| Insertion-withdrawal | good | good | good | good | good | good | good | poor | good | — |
| Flash point | 91° C. | none | none | none | none | none | none | none | none | — |
| Salt spray test | ○ | ○ | ○ | ○ | ○ | ○ | ○ | Δ | ○ | Δ |
| $SO_2$ gas test | Δ | Δ | Δ | Δ | Δ | Δ | Δ | X | Δ | X |

State of solution:
○ clear, uniform dissolution
Δ turbid, emulsion-like
X with OS-124 separated
Salt spray test and $SO_2$ gas test:
○ no change
Δ slight discoloration
X overall corrosion (1) Flash Point and State of Solution The samples were tested for flash point according to the Cleveland open-cup method. The samples in Examples 2 to 7 and Comparative Example 1 were uniform clear solutions having no flash point. The sample in Comparative Example 1 had OS-124 separated into oily sediment.

(2) Test for Insertion-withdrawal Test

This test was conducted on male-female forked contacts (of phosphor bronze) which had undergone electroplating with nickel (2.0 μm thick) and subsequent partial electroplating with gold (0.25 μm thick). The contacts were dipped for 5 seconds in any of the treating solutions shown in Table 1. Dipping was followed by drying with warm air. The treated contacts (crossed at 90 degrees) were manually pushed in and pulled out repeatedly. The force required to do this operation was measured after 1, 10, 20, 30, 40, and 50 repetitions. The samples in Examples 1 to 7 were as good as the sample in Comparative Example 2 (which was treated with methylene chloride in the conventional manner) and were much better than the sample in Comparative Example 3 (which was not treated). The sample in Comparative Example 1 produced no effect because it had OS-124 separated into oily sediment.

(3) Contact Resistance

This test was conducted on a test specimen (phosphor bronze strip measuring 15.5 mm wide and 0.2 mm thick) which had undergone electroplating with nickel (2.0 μm thick) and subsequent partial electroplating with gold (0.2 μm thick). The test specimen was dipped in the sample of each Example and Comparative Example for 5 seconds, followed by drying with warm air. The treated specimen was tested for contact resistance under a load which was changed over a range of 5 to 25 g. The contact resistance was measured continuously at the same point. The results are shown in FIG. 2. The same test as above was carried out after the specimen had been heated at 125° C. for 96 hours. The results are shown in FIG. 3. The results in Examples 1 to 7 (regardless of heat treatment) were identical with those in Comparative Example 2 (conventional treatment with methylene chloride).

(4) Corrosion Resistance Test

This test was conducted on the test specimen as used for the contact resistance test. The test specimen was dipped in the sample of each Example and Comparative Example for 5 seconds, followed by drying with warm air. The treated specimen underwent corrosion resistance test as follows.

(a) Salt Spray Test

This test was conducted according to MIL STD 202F, METHOD 101D, Condition B. The specimen was exposed to 5% sodium chloride solution at 33.9–36.7° C. continuously for 48 hours. The state of corrosion was observed with a magnifier.

(b) $SO_2$Gas Test

This test was conducted according to DIN 40046-36. The specimen was exposed to 10 ppm $SO_2$ gas at 40±1° C. and 75±1% RH for 500 hours. The state of corrosion was observed with a magnifier.

After the salt spray test, the electrical contacts in Comparative Example 1 and Comparative Example 3 (not treated) showed discoloration (browning) in the gold-plated part, whereas the electrical contacts in Examples 1 to 7 showed no discoloration at all and exhibited as good corrosion resistance as the electric contact in Comparative Example 2 (which was treated with methylene chloride in the conventional manner).

After the $SO_2$ gas test, the electrical contacts in Comparative Example 1 and Comparative Example 3 (not treated) showed discoloration (browning) and corrosion spots, whereas the electrical contacts in Examples 1 to 7 showed very little discoloration (browning) and only a few corrosion spots, with the degree of discoloration much lower than that in Comparative Example 3, and exhibited as good corrosion resistance as the electric contact in Comparative Example 2 (which was treated with methylene chloride in the conventional manner).

EXAMPLES 8 TO 14

The treating agents for electrical contacts were prepared according to the formulation shown in Table 2. They were tested in the same manner as mentioned above. The results are shown in Table 2 and FIGS. 3 and 4.

TABLE 2

| Item | Example No. 8 | 9 | 10 | 11 | 12 | 13 | 14 |
|---|---|---|---|---|---|---|---|
| OS-124 | 2 | 4 | 2 | 4 | 2 | 2 | 2 |
| N-methyl-2-pyrrolidone | — | — | — | — | 22 | 40 | 40 |
| γ-butyrolactone | 75 | 76 | — | — | 40 | 30 | 30 |
| 1,3-dimethyl-2-imidazolidinone | — | — | — | — | 8 | 5 | 5 |
| 2-pyrrolidone | — | — | 77 | 80 | 6 | — | — |

TABLE 2-continued

| Item | Example No. 8 | 9 | 10 | 11 | 12 | 13 | 14 |
|---|---|---|---|---|---|---|---|
| Benzotriazole | — | — | — | — | — | — | 0.2 |
| Water | 23 | 20 | 21 | 16 | 22 | 23 | 29 |
| State of solution | ○ | ○ | ○ | ○ | ○ | ○ | ○ |
| Insertion-withdrawal test | good | good | good | good | good | good | good |
| Flash point | none | none | none | none | none | none | none |

State of solution:
○ clear, uniform dissolution
Δ turbid, emulsion-like
X with OS-124 separated (1) Flash Point This test was conducted according to the Cleaveland open-cup method. The samples in Examples 8 to 14, which contain a certain amount of water, were uniform clear solutions having no flash point, as in the case of the samples in Examples 1 to 7.

(2) Test for Insertion-withdrawal Test

Figure 4:
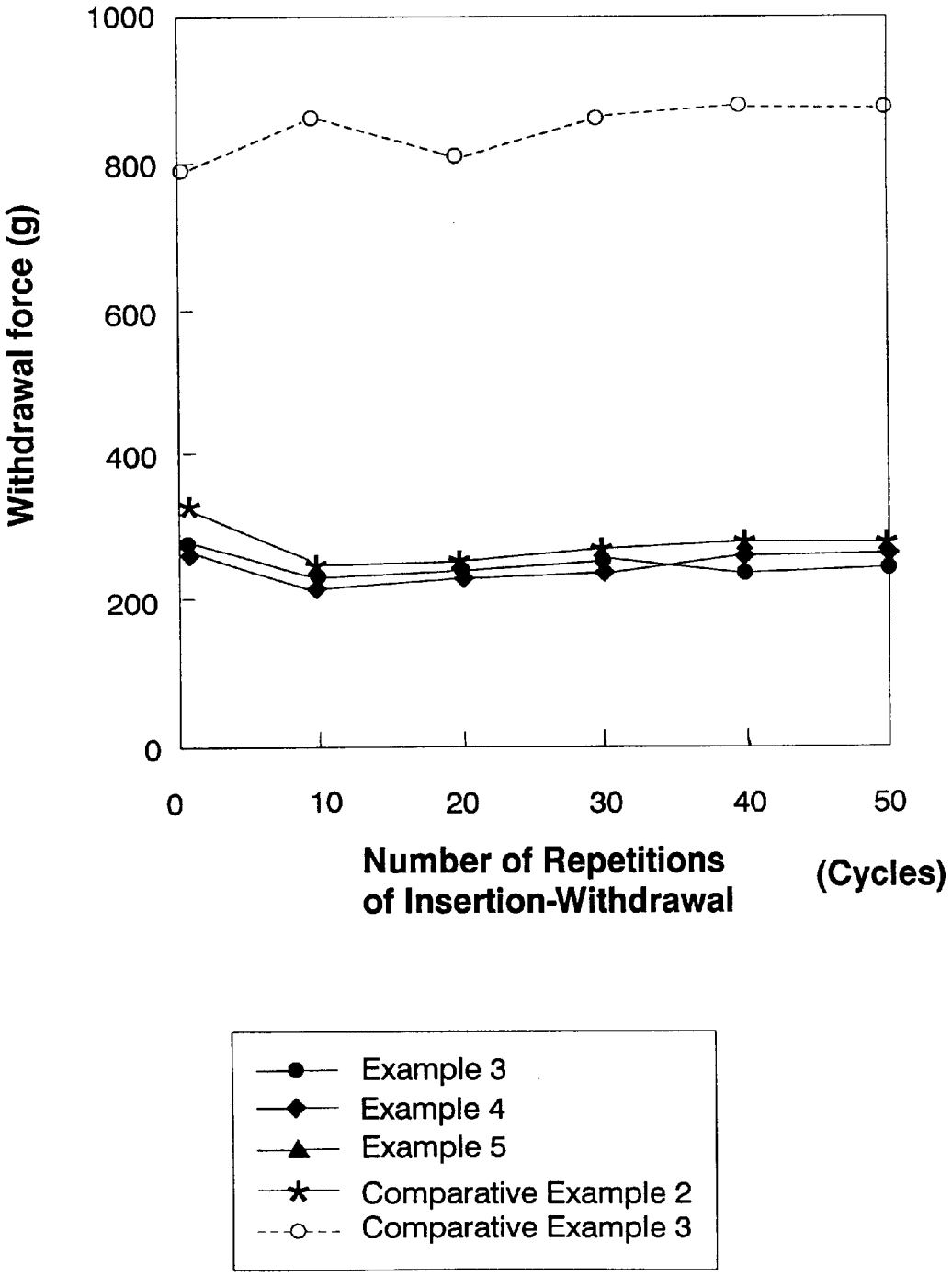
FIG. 4 is a graphs showing the relation between the number of repetitions of Insertion-withdrawal test and the withdrawal force in the case of contacts treated with the samples in Examples 8, 10, 12, and 14.

This test was conducted in the same manner as in Example 1 to 7. The samples in Examples 8 to 14 were much better than the sample in Comparative Example 3 (which was not treated as shown in Table 1). The results of the tests in Examples 8, 10, 12, and 14 and Comparative Example 3 are shown in FIG. 4. All the treating agents were nonflammable and superior in lubricity regardless of the composition of the solvent and the incorporation of the organic compound to produce the effect of protecting metal from corrosion.

As mentioned above, the present invention provides the treating agent for electrical contacts which is nonflammable and free from environmental pollution, imparts good lubricity to the surface of electrical contacts without increasing their contact resistance, and contributes to corrosion resistance.

What is claimed is:

1. A treating agent for electrical contacts comprising a lubricating effective amount of polyphenyl ether in one or more organic solvents selected from lactones, lactams, and cyclic imides.

2. A treating agent for electrical contacts according to claim 1 further comprising water.

3. The treating agent of claim 1, wherein said polyphenyl ether is select from the group consisting of bis(phenoxyphenoxy)benzene and bis(m-(m-phenoxyphenoxy)phenyl)ether.

4. The treating agent of claim 1, wherein said lactone is γ-butyrolactone.

5. The treating agent of claim 1, wherein said lactam is selected from N-methyl-2-pyrrolidone and 2-pyrrolidone.

6. The treating agent of claim 1, wherein said cyclic imide is 1,3-dimethyl-2-imidazolidinone.

7. The treating agent of claim 1, wherein said treating agent comprises from 0.5 to 10% by weight of polyphenyl ether based upon 100% total weight of treating agent.

8. The treating agent of claim 7, wherein said treating agent comprises from 1 to 3% by weight of polyphenyl ether based upon 100% total weight of treating agent.

9. The treating agent of claim 7, wherein said treating agent comprises from 70 to 98% by weight of the organic solvent based upon 100% total weight of treating agent.

10. The treating agent of claim 2, wherein said treating agent comprises up to 30% by weight of water based upon 100% total weight of treating agent.

11. The treating agent of claim 10, wherein said treating agent comprises from 20 to 30% by weight of water based upon 100% total weight of treating agent.

12. The treating agent of claim 1, further comprising a metal inhibitor.

13. The treating agent of claim 12, wherein said metal inhibitor is selected from the group consisting of N,N'-benzotriazole, octadecanethiol, and 2-mercaptobenzothiazole.

* * * * *

UNITED STATES PATENT AND TRADEMARK OFFICE

CERTIFICATE OF CORRECTION

PATENT NO. : 6,143,700

DATED : November 7, 2000

INVENTOR(S) : Masaru KATO

It is certified that errors appear in the above-identified patent and that said Letters Patent is hereby corrected as shown below:

Foremost page, [73] Assignee, "Kanto Kaguka Kabushiki Kaisha"

should be --Kanto Kaguku Kabushiki Kaisha--.

Signed and Sealed this

Eighth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,143,700
DATED : November 7, 2000
INVENTOR(S) : Masaru Kato

It is certified that error appears in the above-identified patent and that said Letters Patent is hereby corrected as shown below:

Title page,
Item [73] Assignee, "Kanto Kaguka Kabushiki Kaisha" should be
-- Kanto Kagaku Kabushiki Kaisha --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*